United States Patent [19]

Keys

[11] Patent Number: 4,610,451

[45] Date of Patent: Sep. 9, 1986

[54] GOLF TEE

[76] Inventor: Francis J. Keys, 9532 Cortada, El Monte, Calif. 91733

[21] Appl. No.: 763,539

[22] Filed: Aug. 8, 1985

[51] Int. Cl.[4] ..... A63B 57/00

[52] U.S. Cl. ..... 273/33; 273/207

[58] Field of Search ..... 273/33, 203, 209, 212, 273/207, 208, 183 E, 183 R, 183 A, 35 R, 185 R, 197 R

[56] References Cited

U.S. PATENT DOCUMENTS

| | | | |
|---|---|---|---|
| 1,736,583 | 11/1929 | Deike | 273/207 |
| 2,470,817 | 5/1949 | Hendricks | 273/207 |
| 4,418,916 | 12/1983 | Matsuura | 273/207 |

*Primary Examiner*—Richard C. Pinkham
*Assistant Examiner*—T. Brown
*Attorney, Agent, or Firm*—John T. Matlago

[57] ABSTRACT

A tee for use in the game of golf is constructed to provide an elongated hollowed body section, a removable head unit that includes a rotatable head section and a stationary head section, and a removable pointed bottom section. The removable head unit is securable to the top of the elongated body section by the stationary head section thereof and the pointed body section is securable to the bottom of the elongated body section. The rotatable head section has attached to the bottom thereof a top rod member which extends down through the stationary head section and has a hook on the lower end thereof and the pointed bottom section has attached to the top thereof a bottom rod member which has a hook on the upper end thereof. A rubber band extending through the hollowed elongated body section is connected between the upper and lower hooks. Upon rotating the rotatable head section by use of the fingers, elastic energy is stored in the rubber band such that when the ball is placed on the tee which is inserted in the ground, the ball will slowly rotate about a vertical axis, thereby helping the golfer to keep his eyes focused on the ball while he is addressing and driving the ball.

6 Claims, 6 Drawing Figures

GOLF TEE

BACKGROUND OF THE INVENTION

This invention relates to devices for use in the game of golf and more particularly to a tee for use by a golfer to improve his game.

When a golfer drives a golf ball placed on a tee, it is important that he keep his eyes on the ball throughout the drive in order for the club head of the driver to properly contact the ball. Most golfers have experienced on occasion, especially during the downswing of the club head during a drive, when his eyes have been inadvertently diverted away from looking at the ball by a movement made by a person or object located within his range of vision. As a result, the club head does not properly contact the ball and the golfer ends up with a bad drive.

Moreover, during the course of a round of golf, when an amateur is playing, his thoughts may drift to other matters, and, although he may appear to be looking down on the ball, he actually is not concentrating on the ball, and, as a result, the club head of the driver does not properly contact the ball and the drive is bad.

Furthermore, it is believed to be well understood that a moving object arouses the attention of a person much more than a stationary one so as to cause one to not only instinctly shift his eyes toward an object that is moving in his range of vision but also to be more mentally alert while doing so.

SUMMARY OF THE INVENTION

In accordance with the present invention, a generally conventionally shaped tee comprises an elongated body section having a removable head unit on the upper end thereof and a removable pointed bottom section on the lower end thereof. The elongated body section is hollowed to provide openings on the upper and lower ends thereof which are interconnected by an axially extending hole.

The removable head unit includes a rotatable upper head section having a curved recess on the top thereof and a stationary lower head section having an integrally formed threaded hub on the bottom thereof. A cylindrical member formed of rubber is located and anchored to the bottom of the threaded hub. A top rod member having a hook on the lower end thereof slideably extends upwardly through an axial hole in the rubber cylindrical member and the lower stationary head section and is anchored in an axial hole on the bottom of the rotatable head section. It should be especially noted that the top rod member extends through the rubber cylindrical member with a desired frictional fit. Secured on the lower end of the top rod member, just above the hook, is a metal disc having pointed projections on the upper surface thereof.

The removable pointed bottom section has a threaded boss on the upper end thereof and a bottom rod member having a hook on the upper end thereof is inserted and anchored in an axial opening on the top of the threaded boss. At the time the tee is assembled, a rubber band is freely positioned within the axially extending hole in the hollow elongated body section and held taut by its ends between the hook on the bottom rod member and the hook on the top rod member. The removable head unit is then engaged by the threaded hub on the bottom of the stationary head section within the threaded cylindrical opening on the top of the elongated body section and the removable pointed bottom section is engaged by the threaded hub on the top thereof within the threaded cylindrical opening on the bottom of the elongated body section.

Prior to the use of the tee, the rotatable head section is rotated about its axis relative to the remainder of the tee by use of the fingers to twist the rubber band until it is fairly tight so as to store elastic energy therein. The rotatable head section is then pulled upwardly relative to the remainder of the tee to cause the pointed projections on the top of the metal disc to engage the bottom surface of the rubber cylindrical member. This locks the rotatable head section relative to the remainder of the tee. When the tee is to be used, a golf ball is placed on the curved recess on the top of the rotatable head section and upon inserting the pointed bottom section of the tee into the ground, the top rod member is caused to shift downward relative to the stationary head section resulting in the pointed projections on the top surface of the metal disc being disengaged from the bottom of the rubber cylindrical member. This frees the rotatable head section so that it can freely rotate relative to the stationary head section by the untwisting of the rubber band. Now, while the golfer has his eyes focused on the slowly rotating ball, he swings his driver and drives the ball, thus greatly minimizing the likelihood that his eyes will be diverted from the ball by a movement made by a person or object within his range of vision.

Accordingly, one of the objects of the present invention is to provide a tee having a head section rotatable with respect to the remainder of the tee for slowly rotating a golf ball placed on the top curved recess thereof about a vertical axis while a golfer addresses the ball and swings his driver to drive the ball.

Another object of the present invention is to provide a simple structure for a tee which enables a ball carried on the head of the tee to be slowly rotated to thereby provide a moving object for the eye of a golfer to concentrate on while he is addressing and following through with his driver to drive the ball.

Another object of the present invention is to provide a tee for use by a golfer wherein the head of the tee on which the golf ball rests is rotatably driven by elastic energy stored in a previously twisted rubber band and wherein the head and bottom of the tee can be easily disassembled to enable the replacing of a broken elongated body section.

Another object of the present invention is to provide a simple lock means for preventing the rotatable head of a tee from starting to rotate until the tee with the golf ball placed on the top of the head thereof has been inserted into the ground.

Yet another object of the present invention is to provide for simply regulating the speed of rotation of a notatable head section of a tee that is being rotated by elastic energy as stored in a previously twisted rubber band.

With these and other objects in view the invention consists of the construction, arrangement and combination of the various parts of the device, whereby the objects contemplated are attained as hereinafter set forth, pointed out in the appended claims and illustrated in the accompanying drawings.

DETAILED DESCRIPTION OF THE PREFERRED EMBODIMENT

Figure 1:
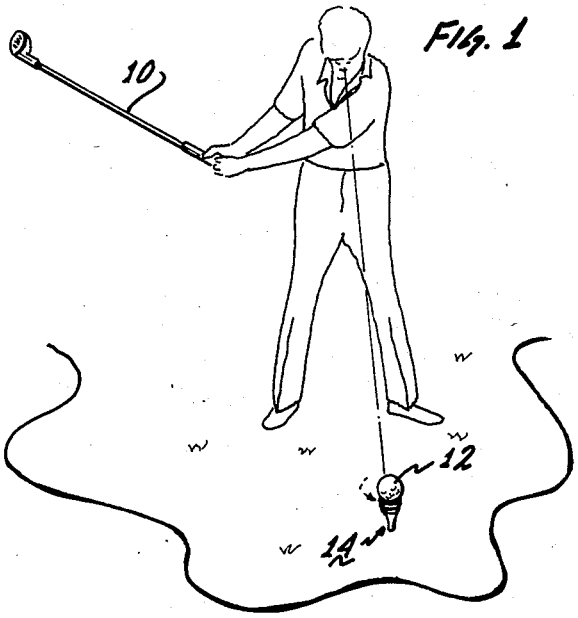
FIG. 1 shows a golfer taking a swing with his driver to drive a golf ball that is slowly being rotated about a vertical axis by the tee of the present invention.

Referring to FIG. 1, a golfer is shown taking a swing with a driver 10 to drive a golf ball 12 which is lying on the head of a tee 14 constructed in accordance with the present invention. As illustrated, while the golfer has his eyes focused on the ball 12, during the swing of the driver 10, the golf ball 12 is being slowly rotated about the vertical axis of the tee 14 on the order of once every 25 or 30 seconds.

Figure 3:
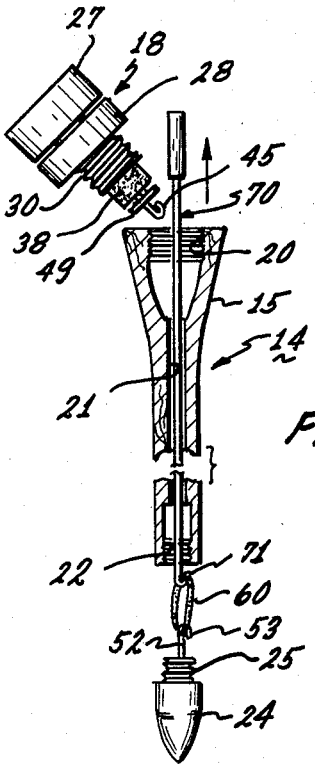
FIG. 3 illustrates a tool for use in placing a rubber band within the elongated body section of the tee during the assembly thereon of the removable pointed bottom section and the removable head unit.

As best illustrated in FIG. 3, the tee 14 comprises an elongated body section 15, a removable head unit 18, and a removable pointed bottom section 24.

Figure 2:
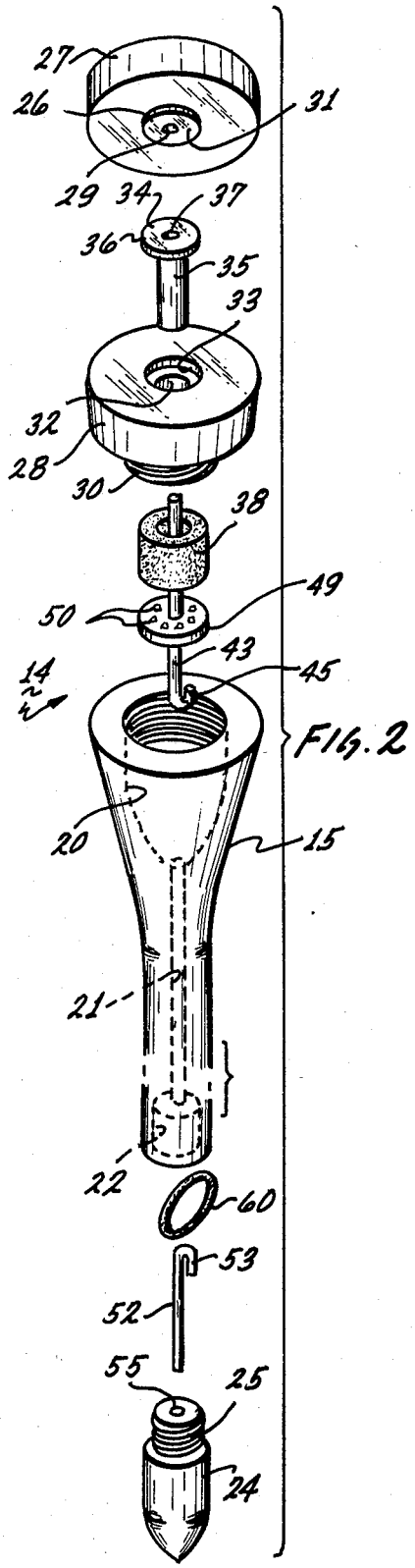
FIG. 2 is an exploded view of the component parts of the tee of the present invention.

Referring to FIG. 2, which shows an exploded view of the component parts of the tee, the elongated body section 5 is hollowed out to provide on the outwardly flared upper end portion thereof an enlarged internally threaded cylindrical opening 20 having a generally rounded bottom and to provide on the lower end portion thereof an internally threaded cylindrical opening 22. The upper and lower cylindrical openings 20 and 22 are connected by a smaller diameter axial hole 21 extending through the elongated body section 15.

The component parts of the removable head unit 18, as shown in FIG. 2, include a rotatable head section 27 having a short cylindrical hub 26 on the bottom thereof and a stationary head section 28 having a threaded boss 30 on the bottom thereof. The stationary head section 28 has a central bore 32 with an enlarged circular opening 33 on the top thereof in which a metal bushing 35 having an enlarged circular upper end 36 is seated and preferably held by glue. A rubber cylindrical member 38 having an axial hole 39 (FIG. 4) has its upper end portion fitted and anchored by an adhesive within a short circular recess 40 (FIG. 4) provided on the bottom of the threaded boss 30 on the stationary head section 28. A top rod member 43 formed with a hook 45 on the lower end thereof has a metal disc 49 attached thereto by solder at a location just above the hook 45. The metal disc 49 has pointed projections 50 formed on the upper surface thereof.

It should now be understood that to complete the assembling of the removable head unit 18, the upper end of top rod member 43 is slid up through the axial hole 39 of the rubber cylindrical member 38 and the axial hole 37 of the metal bushing 35 that extends through the stationary head section 28. The upper end of the top rod member 43 is then inserted into an axial hole 29 on the bottom of the rotatable head section 27 and anchored therein by glue.

The removable pointed bottom section 24 has a reduced diameter threaded boss 25 on the top thereof. A bottom rod member 52 formed with a hook 53 on the upper end thereof has its lower end inserted in an axial hole 55 provided on the upper portion of the pointed bottom section 24 and is anchored therein by glue.

As shown in FIG. 3, at the time the removable head unit 18 and the removable pointed bottom section 24 are to be assembled on the top and bottom ends of the elongated body section 15, one end of a rubber band 60 is placed on the hook 53 of the bottom rod member 52 anchored to the top of the pointed bottom section 24 and then an elongated tool 70 having a hook 71 on the bottom thereof is extended down through the axial hole 21 of the elongated body section 15 to engage the other end of the rubber band 60 and pull it up, thereby stretching it, so that it can be engaged on the hook 45 of the top rod member 43 anchored to the bottom of the rotatable head section 27 of the removable head unit 18. The threaded boss 25 on the top of the removable pointed bottom section 24 is then engaged and seated within the internally threaded cylindrical opening 22 on the bottom of the elongated body section 15 and the threaded boss 30 on the bottom of the stationary head section 28 of the removable head unit 18 is engaged and seated in the internally threaded cylindrical opening 20 on the top of the elongated body section 15.

It should now be clear that the head unit 18 and the bottom section 24 of the tee are made removable to facilitate the placing of the rubber band 60 between the upper hook 45 and the lower hook 53 within the elongated body section 15. Moreover, such a construction enables the head unit 18 and the pointed bottom section 24 to be reused to form a new tee in the event the elongated body section 15 or the rubber band 60 is broken or otherwise damaged during the driving of the ball carried thereon.

Although in the preferred embodiment of the tee, the rotating head section, the stationary head section, the elongated body section and the pointed bottom section are made of wood, these sections could be molded of plastic or could be made of a metal such as aluminum, for example, in order to provide a more durable and sturdy tee.

It should be particularly noted that the axial hole 39 in the rubber cylindrical member 38 is made of such a size as to receive the top rod member 43 with a desired frictional fit so as to control the rate at which the rod member 43, and thereby the rotatable head section 27, will rotate with respect to the remainder of the tee upon being driven by the untwisting of the rubber band 60, as described hereinafter.

Figure 4:
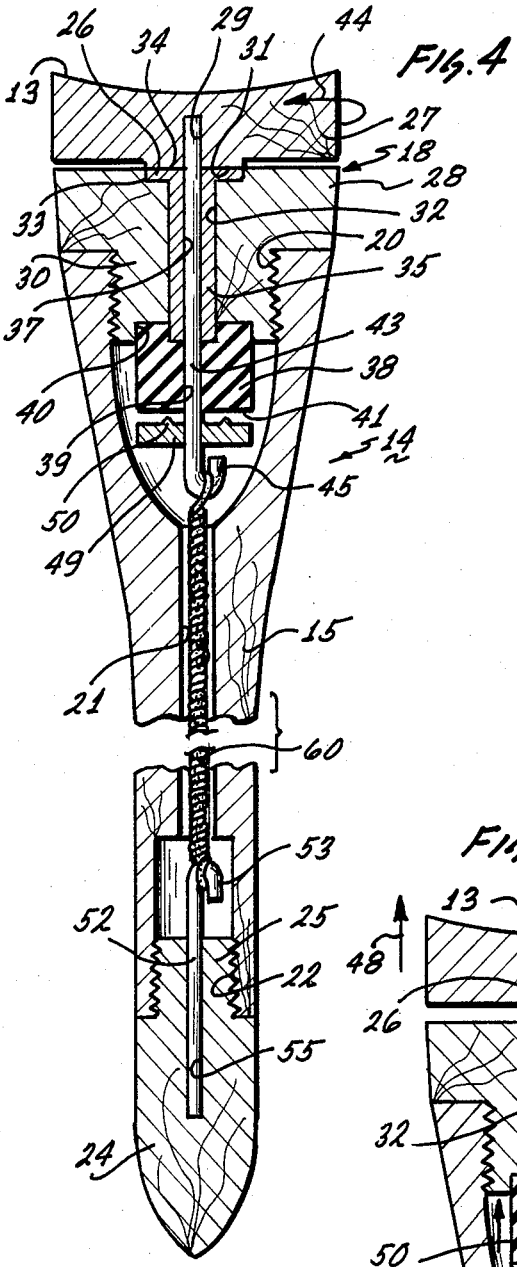
FIG. 4 is a sectional view of the tee after it has been assembled and illustrating how its rubber band is wound up to store elastic energy therein for rotating the rotatable head section with the golf ball on the top thereof.

Referring to FIG. 4, which is a vertical cross section of the assembled tee, the bottom flat surface 31 of the short cylindrical hub 26 on the rotatable head section 27 is shown to be in sliding engagement with the flat top surface 34 of the metal bushing 35 forming the center of the stationary head section 28. When so positioned the pointed projections 50 on the upper surface of the metal disc 49 which is attached to the top rod member 43 just above the hook 45 are out of engagement with the flat bottom surface 41 of the rubber cylindrical member 38.

As further shown in FIG. 4, the assembled tee 14 can now have the rubber band 60 spanning the upper hook 45 and the lower hook 53 wound up to store elastic energy therein by rotating the rotatable head section 27 with one's fingers, as indicated by arrow 44, with respect to the remainder of the tee.

Figure 5:
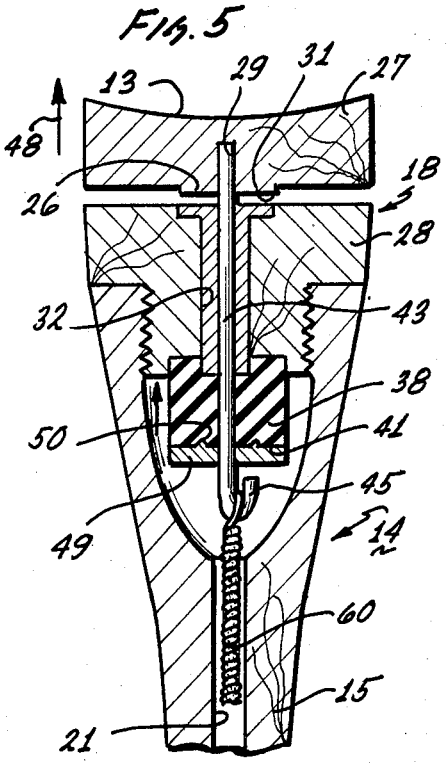
FIG. 5 is a partial sectional view showing the rotatable head section of the tee after having been pulled away from the remaining parts of the tee to lock the rotatable head section in position.

After the rubber band 60 has been wound to the point that the fingers doing the rotating sense that the rubber band 60 is fairly tense, the rotatable head section 27 can be pulled axially outwardly relative to the stationary head section 28, as indicated in FIG. 5, by arrow 48. This causes the top rod member 43 to shift upwardly relative to the stationary head section 28 such that the pointed projections 50 on the upper surface of the metal disc 49 engage the bottom flat surface 41 of the rubber cylindrical member 38 and thereby lock the top rod member 43, and, therefore, the rotatable head section 27, onto the stationary head section 28, so that the rotatable head section 27 can not rotate relative thereto.

Figure 6:
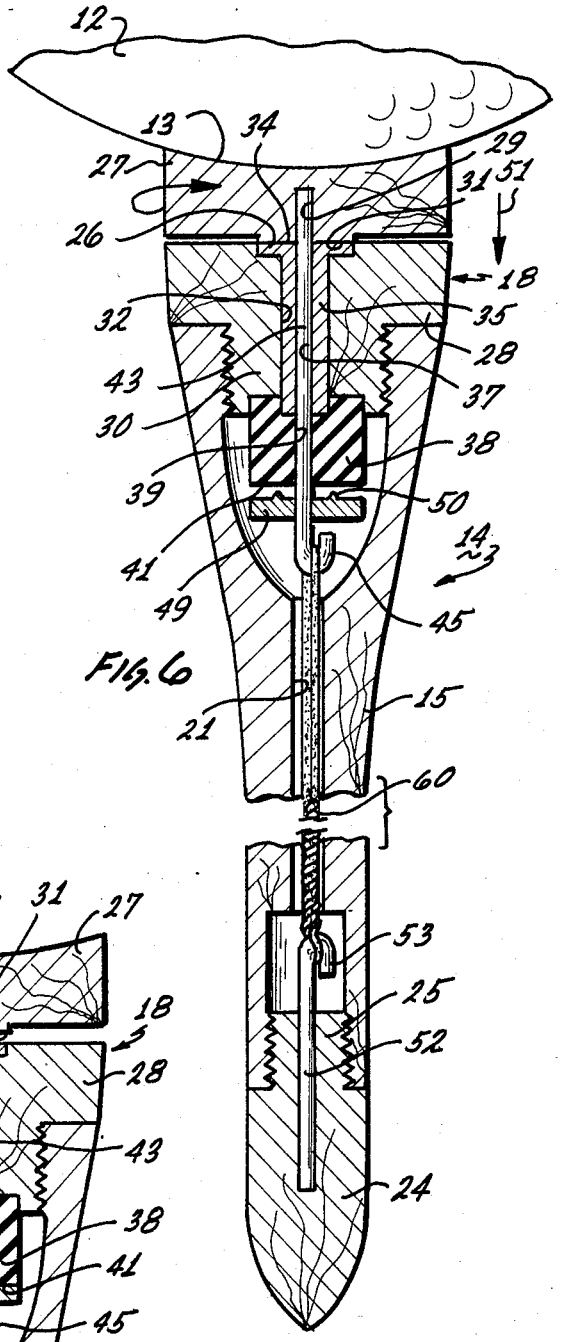
FIG. 6 is a sectional view showing the golf ball on the top of the rotatable head section which has been pushed down and freed from the stationary head section so that it can be rotated by the untwisting of the rubber band.

Now then, when it is desired to use the tee 14, the golfer takes the wound-up tee out of his pocket or wherever has it stored and places a golf ball 12 on the curved recess 13 provided on the top of the rotatable head section 27 of the tee (FIG. 6) and positions the palm of his hand over the ball while straddling the elongated body section 15 of the tee with his first two fingers. The golfer then applies the pressure of his palm on the ball 12 to force the pointed bottom section 24 of the tee 14 into the ground. This downward pressure, as indicated by arrow 51, in FIG. 6, causes the rotatable head section 27 to be pushed down such that its short cylindrical hub 26 contacts the top surface 34 of the metal bushing 35 on the stationary head section 28 and advances the top rod member 43 relative to the stationary head section 28 such that the pointed projections 50 on the upper surface of the metal disc 49 are pushed free of the bottom surface 41 of the rubber cylindrical member 38, as shown in FIG. 6. This permits the previously wound-up rubber band 60 to rotate the rotatable head section 27 relative to the remainder of the tee at a rate which is on the order of one revolution every 25 to 30 seconds.

Now then, when the golfer has his eyes focused on the golf ball 12 placed on the tee 14, as he is addressing the ball and completing his swing of the driver, because of the fact that the ball is slowly rotating, the golfer is less likely to have his attention diverted by movements of any objects or persons that may happen to be in his range of vision as he is addressing the ball and completing his swing of the driver to drive the ball.

While a preferred embodiment of the golf tee described herein is well adapted to fulfill the objects and advantages previously mentioned as desirable, it is to be understood that the invention is not limited to the specific features shown and described but that the means and configuration herein disclosed are susceptible of modification in form, proportion and arrangement of parts, without departing from the principles involved or sacrificing any of its advantages, and the invention is, therefore, claimed in embodiments of various forms all coming within the scope of the claims which follow:

What is claimed is:

1. A golf tee comprising:

an elongated body section including an upwardly and outwardly flared upper end portion having an internally threaded opening and a lower end portion having an internally threaded opening with an axial hole joining the upper and lower openings;

a removable head unit including a rotatable head section having a curved recess on the top thereof and a stationary head section having a threaded boss on the bottom thereof; and a top rod member having a hook on the lower end thereof and having its upper end slideably extending through an axial hole in said stationary head section and anchored in an axial hole on the bottom of said rotatable head section;

said removable head unit being held by the threaded boss on the lower end of the stationary head section engaging the internally threaded opening on the upper end portion of said elongated body section;

a pointed bottom section having a threaded boss on the top thereof;

a bottom rod member having a hook on the upper end thereof and having its lower end anchored in an axial opening on the top of said pointed bottom section;

said pointed bottom section being held by the threaded boss on the upper end thereof engaging the internally threaded opening on the lower end portion of said elongated body section; and a rubber band extending freely through the axial hole in said elongated body section with its upper end engaged over the hook on the top rod member and with its lower end engaged over the hook on the bottom rod member.

2. A golf tee as defined in claim 1 wherein a rubber cylindrical member having an axial hole is secured to the bottom of the threaded boss on the lower end of said stationary head section, and wherein a metal disc having pointed projections on the upper surface thereof is attached to said top rod member just above the hook provided on the lower end thereof.

3. A golf tee as defined in claim 1 wherein said stationary head section is provided with an axial opening therethrough and a short enlarged recess on the top surface thereof and including a metal bushing having an enlarged top which is seated in said axial opening and said recess, said metal bushing providing the axial hole through which said top rod member slideably extends, and wherein said rotatable head section has a short hub on the bottom thereof which slideably engages the enlarged top on said bushing.

4. A golf tee as defined in claim 1 wherein said rotatable head section, said stationary head section, said elongated body section, and said bottom section are made of wood.

5. A golf tee comprising:

a hollow elongated body section;

a head unit including a rotatable head section and a stationary head section having an axial bore therethrough, said stationary head section secured on the top of said elongated body section;

a top rod member slideably extending through the axial bore of said stationary head section and anchored on the botom of said rotatable head section, said top rod member having a hook on the lower end thereof extending into said hollow elongated body section;

a pointed bottom section secured on the bottom of said elongated body section;

a bottom rod member anchored on the top of said pointed bottom section and having a hook on the upper end thereof extending into said hollow elongated body section; and an elongated elastic element extending through said hollow elongated body section and having one end thereof connected to the upper hook and the other end thereof connected to the lower hook;

whereby said rotatable head section is manually axially rotated relative to the stationary head section to thereby twist said elongated elastic element and store elastic energy therein; and whereby when a golf ball is placed on said rotatable head section and the pointed bottom section of the tee is inserted in the ground the rotatable head section with the golf ball thereon is axially rotated by the untwisting of said elongated elastic element to hold the attention of a golfer while addressing and driving the ball.

6. A golf tee as defined in claim 5 wherein said rotatable head section with the golf ball carried on the top thereof will rotate at a rate of approximately once every 25 to 30 seconds.

* * * * *